US005951005A

United States Patent [19]

Bartman et al.

[11] Patent Number: 5,951,005

[45] Date of Patent: Sep. 14, 1999

[54] AIR CORRUGATED STACKING

[75] Inventors: David A. Bartman, Webster; Paul M. Achtziger, Ontario; Daniel L. Morris, Webster, all of N.Y.

[73] Assignee: Xerox Corporation, Stamford, Conn.

[21] Appl. No.: 09/055,444

[22] Filed: Apr. 6, 1998

[51] Int. Cl.[6] ..... B65H 29/70

[52] U.S. Cl. ..... 271/188; 271/209; 271/211

[58] Field of Search ..... 271/188, 209, 271/211

[56] References Cited

U.S. PATENT DOCUMENTS

| | | | |
|---|---|---|---|
| 4,772,008 | 9/1988 | Spencer et al. | 271/188 X |
| 5,280,901 | 1/1994 | Smith et al. | 271/188 |

FOREIGN PATENT DOCUMENTS

| | | | |
|---|---|---|---|
| 59-203053 | 11/1984 | Japan | 271/188 |

*Primary Examiner*—David H. Bollinger

*Attorney, Agent, or Firm*—Lloyd F. Bean, II

[57] ABSTRACT

There is provided document stacking stacker for stacking documents exiting a wide format machine, including a sheet tray having a planar base plate for stacking sheets thereon and a side wall for abutting sheets thereagainst; guides disposed adjacent the tray to direct sheets therein at an angle relative to the plane of the base plate, a feeder associated with the guides to feed sheets through the guides into the tray; a corrugating bar includes an array air corrugaters, the air corrugators are connected to an air plenum, each of the air corrugators have an air discharge ports for discharge of air against incoming bottom surface of sheets in the direction of movement of the sheets to corrugated the sheets as the sheet is feed to the tray.

3 Claims, 4 Drawing Sheets

AIR CORRUGATED STACKING

FIELD OF THE PRESENT INVENTION

The present invention relates to a copier/printer machine that prints page image information onto copy sheets, and more particularly, to an air corrugated document stacker for such a machine.

BACKGROUND OF THE PRESENT INVENTION

In the process of electrostatographic reproduction, a light image of an original to be copied is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure With the advent of wide format xerography reproduction machines wherein wide format copies can be produce at a high rate, the need for sheet handling system to, for example feed document through each process station in a rapid succession in a reliable and dependable manner in order to utilize the full capabilities of the reproduction machine. These sheet handling systems must operate flawlessly to virtually eliminate risk of damaging the recording sheets and generate minimum machine shutdowns due to misfeeds or document multifeeds. It has been found that in the feeding and stacking of particularly wide format document sheets have been difficult to feed and stack without the fear of marking, deforming or damaging of the wide format document sheet. It has been also found that the greatest number of problems occur which, in some cases, can be due to up curl and downcurled in document sheets exiting the copier/printer being stacked in a non planar condition in a stacking tray. These non planar stacked sheets, interfere with subsequently exiting document sheets thereby causing marking, deforming or damaging of exiting wide format document sheets.

Heretofore, users of wide format copiers/printers would visibly monitor the stacking/feeding operation and intervene when curling occurred and manually assist the feeding of a curled sheet so that sheet is held and delivered sheets in a planar condition in the stacking tray. This result in wasted user time in monitoring the copier/printer.

SUMMARY OF THE PRESENT INVENTION

A simple, relatively inexpensive and accurate approach to improved sheet feeding and stacking performance in a wide format type reproduction machines has been a goal in the design, manufacture and use of xerographic printers. The need has become more acute when feeding and stacking documents which have substrates composed of thin film and velum that become limp and difficult to handle due to the retention of heat obtained during the fusing operation.

Briefly, the present invention obviates the above mention problems in stacking/feeding of wide format document sheets. There is provided document stacking stacker for stacking documents exiting a wide format machine, including a sheet tray having a planar base plate for stacking sheets thereon and a side wall for abutting sheets thereagainst; guide means disposed adjacent the tray to direct sheets therein at an angle relative to the plane of the base plate, feed means associated with the guide means to feed sheets through the guide means into the tray; a corrugating bar includes an array air corrugaters, the air corrugators are connected to an air plenum, each of the air corrugators have an air discharge ports for discharge of air against incoming bottom surface of sheets in the direction of movement of the sheets to corrugated the sheets as the sheet is feed to the tray.

It is therefore, an object of this invention to provide a document stacking apparatus that allows a user to copy multi-set documents of various sizes in a continuous mode until the set is completed without user involvement. Therefore, the present invention provides a document stacking apparatus that collects and collates wide format document sheets.

DETAILED DESCRIPTION OF THE PRESENT INVENTION

Figure 1:
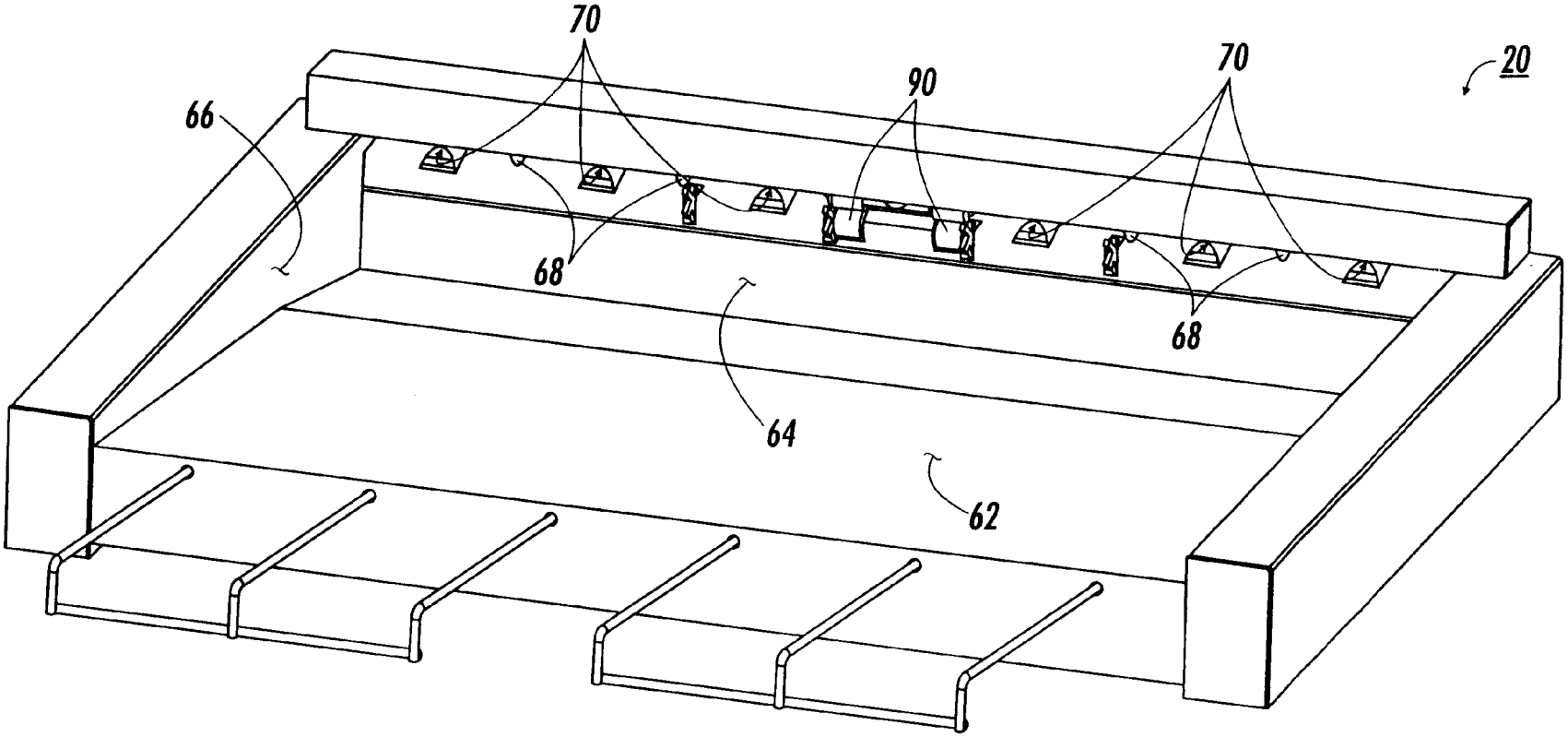
FIG. 1 is an enlarged, partial schematic side view showing the document stacker of the present invention attached to the copier/printer of FIG. 2.
Figure 2:
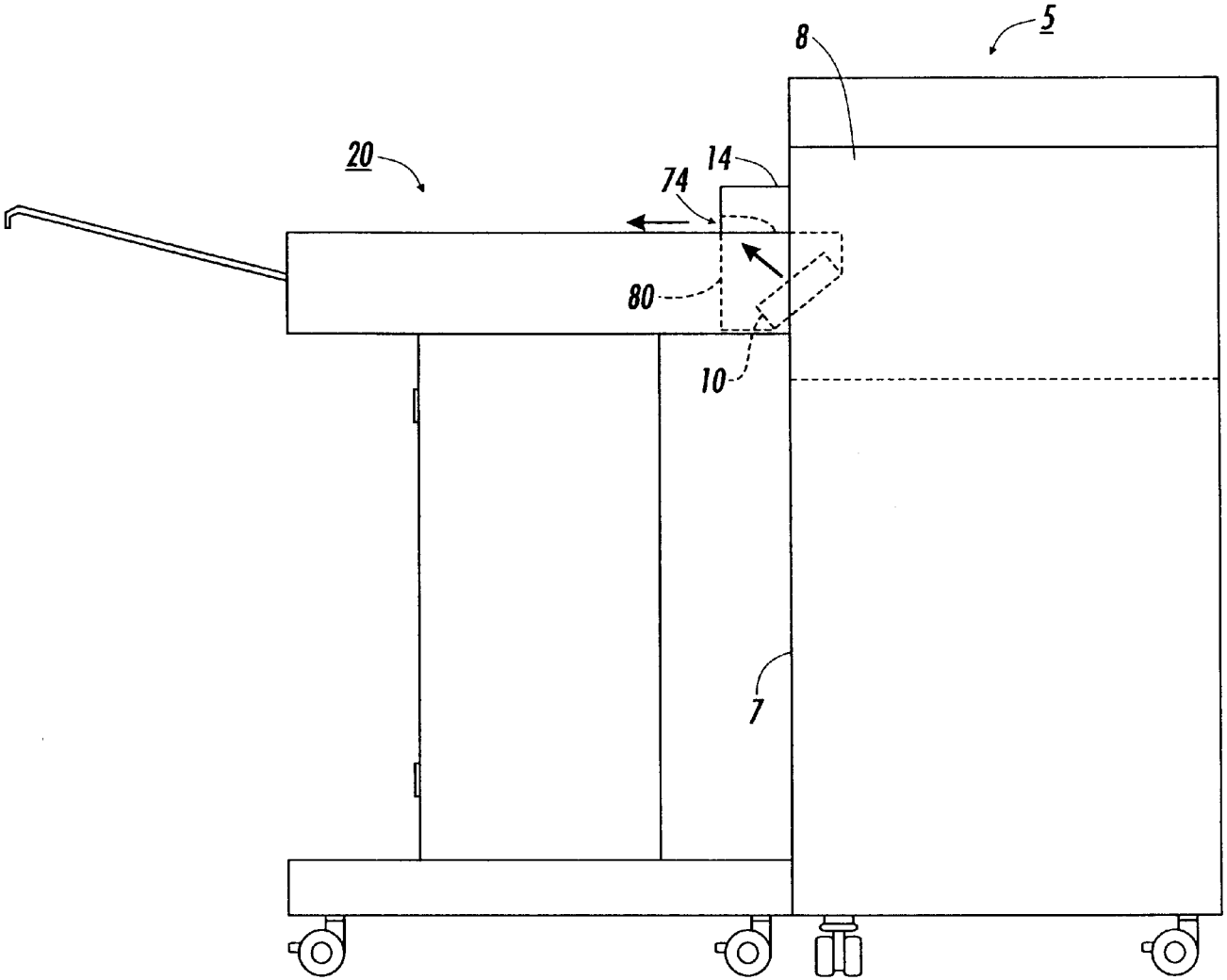
FIG. 2 is a schematic side view of a copier/printer to which the document stacker of the present invention attached thereto.

Referring now to the drawings in detail, and wherein like numbers indicate like elements, document stacker 20 in FIG. 2 is shown attached to the exit side of a copier/printer 5, of the type shown, for example, in U.S. Pat. No. 5,040,777 which is incorporated herein by reference. The copier/printer 5 includes housing 8 that incorporates the machine's xerographic section (ie., charging, imaging, developing, and heat fixing section) and a copy sheet supply section 7.

Copier/printer 5 also includes document exit 14 which includes conventional means for driving the documents into document stacker 20. The documents sheets employed with the present invention can be sheets such as (ie. A4 to A0-size bond, vellum, film, tracing paper)

Figure 3:
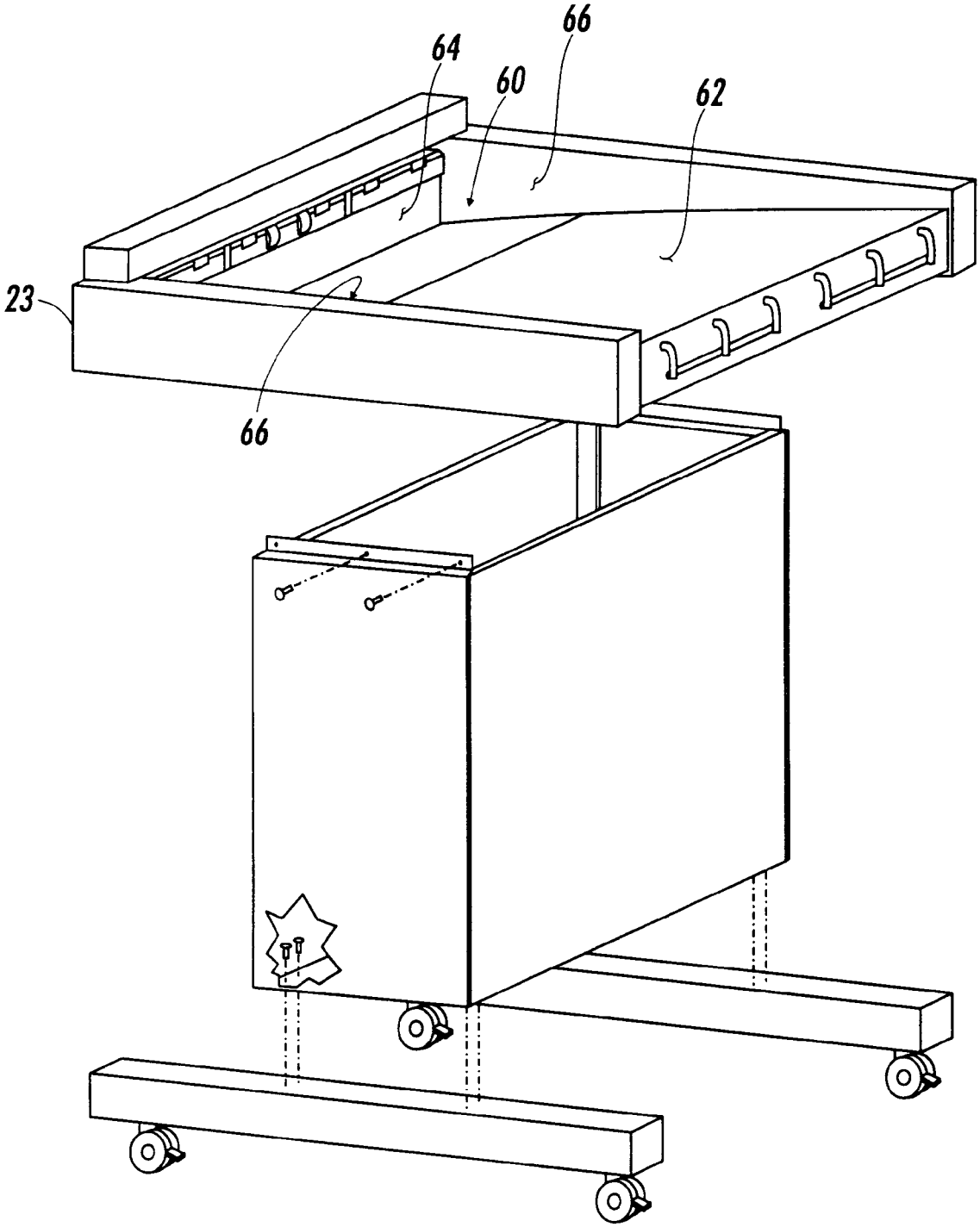
FIG. 3 is an enlarged side view of the document stacker of the present invention.
Figure 4:
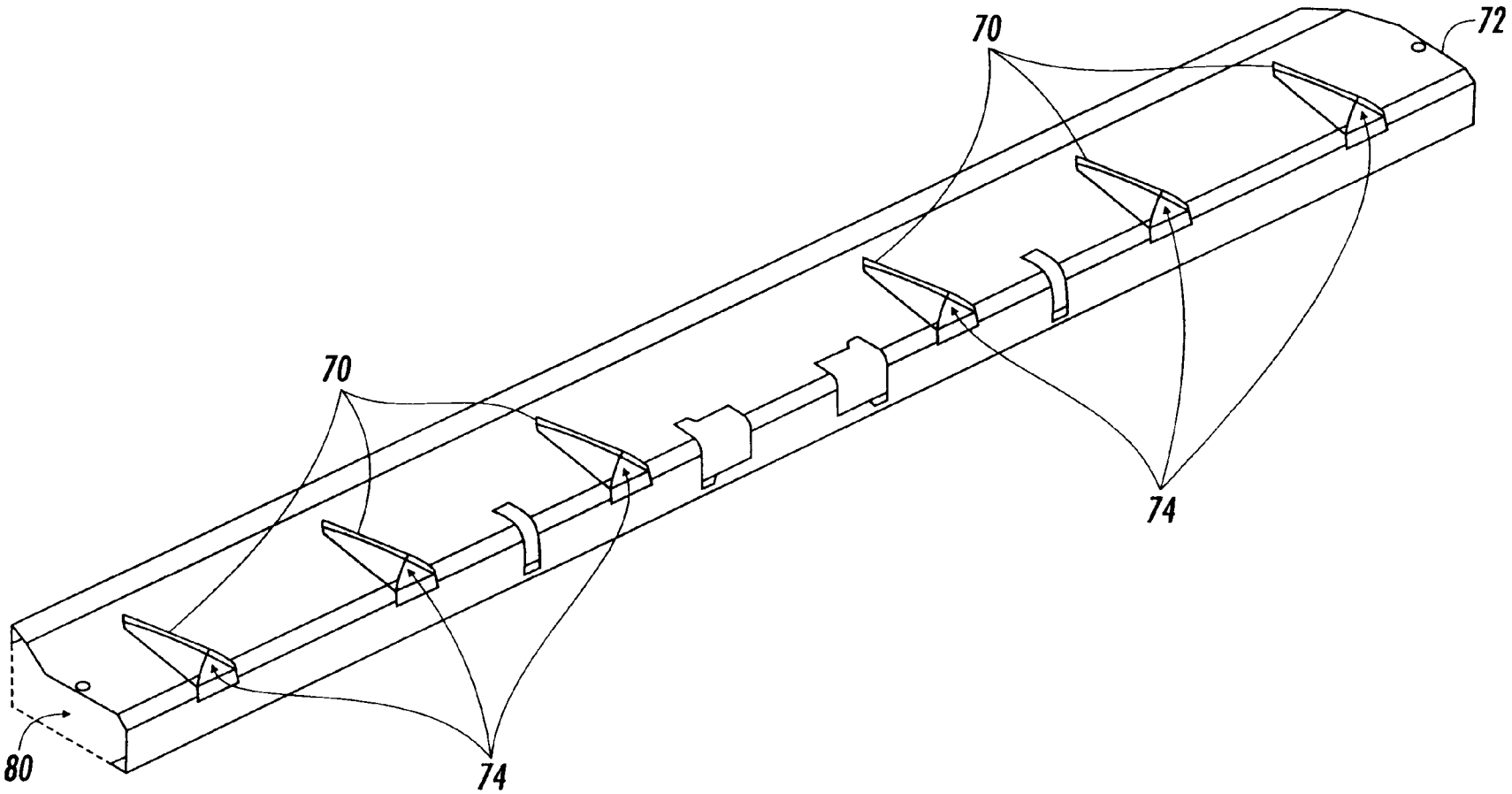
FIG. 4 is an enlarged view of the air curragator bar used in the present invention.

Stacker 20 is a removable unit as shown in FIG. 3 comprises an upstanding wall 23 that is parallel and attached by suitable means, such as screws or clamps, to a vertical wall of the machine and positioned to receive documents as they are propelled through exit 14. The document stacker has a 30 sheet tray 60 having a planar base plate 62 for stacking sheets thereon and a wall 64 for abutting sheets thereagainst; guide walls disposed adjacent the tray to direct sheets therein at an angle relative to the plane of the base plate. Feed rollers are disposed in the center of the guide wall 64 to feed sheets along the guide wall 64 into the tray. Upper corrugators 68 contacts the top surface of the exiting sheet. Each upper corrugator is positioned between each air corrugator 70. A lower corrugating bar contacts the bottom surface of sheet as feed roller move the sheet into the sheet tray. Lower corrugating bar 72 includes an array triangular air corrugaters 70. Air Corrugators are connected to an air plenum 80, each of the corrugators have air discharge ports 74 for discharge of air against incoming bottom surface of sheets in the direction of movement of the sheets to corrugated the sheets as the sheet is driven toward to sheet tray resulting in sheets can be held and delivered in a planar condition.

Air supplied by fan (not shown) is distributed through manifold 80 to air corrugators. This supplied air is delivered in such a manner to provide sufficient uplift force to float the output media to its destination 62.

Applicants have found that the present invention is particularly useful in feeding and stacking of thin film and velum that become limp and difficult to transport due to the retention of heat obtained during the fusing operation. In operation the stacker of the present invention, the center of the sheet is driven by rollers 90 while the outside regions are corrugated to add beam strength to the substrates so that they can be stacked in the sheet tray. By corrugating outside the drive zone, leaves the sheet unstressed while producing beam strength to push the sheet into the sheet tray. Air corrugators also provide an air layer to float the document along, simultaneously cooling the document faster.

This invention has been described in detail with particular reference to a preferred embodiment thereof, but it will be understood that variations and modifications can be effected within the spirit and scope of the invention and all such variations and modifications are intended to be covered by the appended claims.

What is claimed is:

1. A document stacking stacker for stacking documents exiting a wide format machine, comprising:

a sheet tray having a planar base plate for stacking sheets thereon and a side wall for abutting sheets thereagainst;

guide means disposed adjacent said tray to direct sheets therein at an angle relative to the plane of said base plate, feed means associated with said guide means to feed sheets through said guide means into said tray;

a corrugating bar includes an array air corrugaters, said air corrugators are connected to an air plenum, each of the air corrugators have an air discharge ports for discharge of air against incoming bottom surface of said sheets in the direction of movement of the sheets to corrugated the sheets as the sheets are feed to said tray.

2. The document stacker of claim 1, further comprising: a plurality of corrugators that contacts a top surface of the sheet as the sheet is feed to said tray.

3. The document stacker of claim 1, wherein said feed means contacts substantial a central portion of said sheets.

* * * * *